US008710435B2

(12) United States Patent
Hutchinson et al.

(10) Patent No.: US 8,710,435 B2
(45) Date of Patent: Apr. 29, 2014

(54) SAMPLE CHAMBER FOR LASER ABLATION INDUCTIVELY COUPLED PLASMA MASS SPECTROSCOPY

(71) Applicants: Robert Hutchinson, Huntingdon (GB); Leif Summerfield, Bozeman, MT (US); Shane Hilliard, Bozeman, MT (US); Jay Wilkins, Belgrade, MT (US)

(72) Inventors: Robert Hutchinson, Huntingdon (GB); Leif Summerfield, Bozeman, MT (US); Shane Hilliard, Bozeman, MT (US); Jay Wilkins, Belgrade, MT (US)

(73) Assignee: Electro Scientific Industries, Inc., Portland, OR (US)

( * ) Notice: Subject to any disclaimer, the term of this patent is extended or adjusted under 35 U.S.C. 154(b) by 0 days.

(21) Appl. No.: 13/658,062

(22) Filed: Oct. 23, 2012

(65) Prior Publication Data

US 2013/0042703 A1 Feb. 21, 2013

Related U.S. Application Data

(62) Division of application No. 12/752,788, filed on Apr. 1, 2010, now Pat. No. 8,319,176.

(51) Int. Cl.
*H01J 49/00* (2006.01)

(52) U.S. Cl.
USPC ..... 250/288

(58) Field of Classification Search
USPC ..... 250/281, 282, 288
See application file for complete search history.

(56) References Cited

U.S. PATENT DOCUMENTS

| | | | | |
|---|---|---|---|---|
| 3,628,213 | A * | 12/1971 | Ramo | 15/352 |
| 3,962,975 | A | 6/1976 | Monserie | |
| 4,640,617 | A | 2/1987 | Hughes et al. | |
| 5,135,870 | A | 8/1992 | Williams et al. | |
| 5,177,561 | A | 1/1993 | Milosevie et al. | |
| 5,526,110 | A | 6/1996 | Braymen | |
| 5,543,621 | A | 8/1996 | Sauke et al. | |
| 5,558,697 | A * | 9/1996 | Dyson et al. | 95/12 |
| 5,724,669 | A * | 3/1998 | Snyder et al. | 588/2 |
| 6,670,623 | B2 | 12/2003 | Vella | |
| 7,238,280 | B1 | 7/2007 | King | |
| 7,274,450 | B1 | 9/2007 | Green et al. | |
| 7,875,847 | B2 | 1/2011 | Dugas et al. | |

(Continued)

FOREIGN PATENT DOCUMENTS

EP 1118692 A1 7/2001

OTHER PUBLICATIONS

Derwent Patent Abstracts for German Patent DE 3048219 A.*
International Preliminary Report of PCT/US2011/030757, 1 page.

(Continued)

*Primary Examiner* — Robert Kim
*Assistant Examiner* — Jason McCormack
(74) *Attorney, Agent, or Firm* — Haynes Beffel & Wolfeld LLP

(57) ABSTRACT

An improved sample chamber for laser assisted spectroscopy integrates valve mechanisms into the sample drawer, permitting the sample chamber to automatically bypass, purge and resume flow as the sample drawer is opened and closed to insert samples for processing. Integrating valve mechanisms into the sample drawer in this manner eliminates the need for external valves to be operated to bypass, purge and resume flow, thereby increasing system throughput and reducing system complexity.

11 Claims, 7 Drawing Sheets

(56) References Cited

U.S. PATENT DOCUMENTS

| | | | | |
|---|---|---|---|---|
| 2004/0200227 | A1* | 10/2004 | Melching et al. | 62/63 |
| 2004/0200277 | A1* | 10/2004 | Feldstein et al. | 73/304 R |
| 2005/0276724 | A1 | 12/2005 | Bremauer | |
| 2006/0105359 | A1 | 5/2006 | Favuzzi et al. | |
| 2007/0107457 | A1 | 5/2007 | Morris | |
| 2008/0029393 | A1 | 2/2008 | Krumme | |
| 2008/0105843 | A1 | 5/2008 | Koenekamp | |
| 2008/0245770 | A1 | 10/2008 | Brancher et al. | |
| 2008/0264090 | A1 | 10/2008 | Sowa et al. | |
| 2009/0065689 | A1 | 3/2009 | Bateman | |
| 2009/0073586 | A1 | 3/2009 | Fry et al. | |
| 2009/0090858 | A1 | 4/2009 | Musselman | |
| 2010/0205992 | A1 | 8/2010 | Morris | |
| 2011/0200486 | A1 | 8/2011 | Beumer et al. | |
| 2011/0209766 | A1* | 9/2011 | Witt et al. | 137/1 |

OTHER PUBLICATIONS

Written Opinion of the International Search Authority of PCT/US2011/030757, 3 pages.

* cited by examiner

SAMPLE CHAMBER FOR LASER ABLATION INDUCTIVELY COUPLED PLASMA MASS SPECTROSCOPY

CROSS REFERENCE TO RELATED APPLICATIONS

This application is a Divisional of U.S. patent application Ser. No. 12/752,788, filed on Apr. 1, 2010, now U.S. Pat. No. 8,319,176 issued on 27 Nov. 2012, which is incorporated by reference in its entirety.

TECHNICAL FIELD

The present invention relates generally to spectroscopy. More particularly it relates to laser ablation inductively coupled plasma mass spectroscopy (LA ICP-MS), laser ablation inductively coupled plasma emission spectroscopy (ICP-OES/ICP-AES) and matrix assisted laser desorption ionization time of flight (MALDI-TOF) spectroscopy. Specifically, it relates to sample chambers associated with these and other laser-assisted spectroscopy (LAS) systems including some optical spectroscopes. More specifically, the present invention relates to improvements to sample chambers for LAS. LAS often has the sample to be examined be in a flow of fluids, typically an inert gas although sometimes a liquid. The present invention relates to an improved apparatus for automatically bypassing, purging and restoring flow when the sample chamber is opened and closed, for example when a new sample is introduced to the sample chamber.

BACKGROUND OF THE INVENTION

LAS involves directing laser energy at a sample of matter in order to disassociate its constituent parts and make them available to a spectrometer for processing. Operation of LAS systems and other laser assisted spectroscopy systems typically apply this energy to the sample while passing a fluid, typically an inert gas, over the sample to capture the disassociated species and carry them to a spectroscope for processing. Sampling and detecting constituent parts of a sample with mass or optical spectrometry using an inert gas flow is necessary since, for example, an inductively coupled plasma instrument depends upon a plasma torch to ionize the laser ablated material for subsequent processing. This plasma torch can only operate in an inert atmosphere since regular open atmosphere extinguishes the plasma torch. Another advantage to using inert gas flow for laser assisted spectroscopy is that certain inert gases are transparent to desired laser wavelengths whereas regular room atmosphere is not. In addition, inert atmospheres can prevent Commonly, LAS systems require opening their sample chambers to remove old samples and insert new samples. While this is happening, it is important to maintain the flow of inert gas to the spectrometer and prevent air from reaching the plasma torch and extinguishing it, among other reasons. For the same reasons, the sample chamber must be purged of air prior to connection to the spectrometer following opening and closing. Once the plasma torch is extinguished, the system must be restarted and recalibrated, taking time and expertise. In order to prevent room atmosphere from entering the instrument, care must be taken when the sample chamber is opened to insert a new sample. The problem of purging a sample chamber of room atmosphere following insertion of a new sample has been previously considered with varying results.

Laser assisted mass spectroscopy is described in U.S. Pat. No. 5,135,870 LASER ABLATION/IONIZATION AND MASS SPECTROSCOPIC ANALYSIS OF MASSIVE POLYMERS, inventors Peter Williams and Randall W. Nelson, Aug. 4, 1992. This patent describes using a laser to ablate a thin film of organic material in a vacuum and thereafter analyze it using a mass spectrometer. A more recent publication, US patent application No. 2009/0073586A1 ANALYTICAL LASER ABLATION OF SOLID SAMPLES FOR ICP, ICP-MS, AND FAG-MS ANALYSIS, inventors Robert C. Fry, Steven K. Hughes, Madeline J Arnold, and Michael R. Dyas, Mar. 19, 2009 describes in detail a radiation-hardened sample chamber design for a laser ablation system. A reference which discusses the issue of purging sample cells is U.S. Pat. No. 4,640,617 SPECTROMETERS HAVING PURGE RETENTION DURING SAMPLE LOADING, inventors Norman S. Hughes and Walter M. Doyle, Feb. 3, 1987. This patent discloses and claims a means for minimizing the amount of air introduced into the sample chamber during sample loading by using a spring-loaded plunger to seal the sample chamber while loading a sample. U.S. Pat. No. 5,177,561 PURGING OF OPTICAL SPECTROMETER ACCESSORIES, inventors Milan Milosevic and Nicolas J. Harrick, Jan. 5, 1993 discloses a means to minimize purging by separating the sample chamber atmosphere from the spectrometer atmosphere, thereby eliminating the need to purge the spectrometer when samples are changed.

These patents have considered issues associated with purging sample chambers, mainly by minimizing the amount of room atmosphere introduced into the sample chamber as a new sample is introduced but have not considered solutions which alter the fluid flow through the system as the sample chamber is opened and closed. FIGS. 1*a-c* show an example of a prior art solution to the problem of providing: 1. Gas bypass when the sample chamber is open; 2. Gas purge when the sample chamber is initially closed; and, 3. Restoring gas flow after the sample chamber is purged. In FIG. 1*a*, fluid flow 14 (represented by the arrows marked "IN": and "OUT") enters the system via fluid inlet 12. This fluid flow 14 then enters inlet valve 16, which is in the "input bypass" position, sending the fluid 14 through the bypass tube 22 to the fluid outlet 24. The outlet valve 20 is in the "output bypass/purge" position closing communication between the sample chamber 10 and the fluid outlet 24. In this position, the sample chamber door 11 can be opened to remove or insert samples without risking contamination of the instrument (not shown) attached to the fluid outlet 24. In FIG. 1*b*, the inlet valve 16 is set to the "purge/restore" position, sending fluid 14 from the fluid inlet 12 to the sample chamber 10 via the inlet tube 18 and then onto the outlet valve 20 via the outlet tube 28. The outlet valve 20 is set to the "bypass/purge" position, sending the fluid from the sample chamber to the vent 26, thereby purging the sample chamber 10. In this mode, the sample chamber door 11 is closed. In FIG. 1*c*, the inlet valve 16 is set to the "purge/restore" position, sending the fluid 14 from the fluid inlet 12 to the sample chamber 10 via the inlet tube 18. The outlet valve 20 is set to the "restore" position, sending fluid 14 from the sample chamber 10 to the fluid outlet 24 via the bypass tube 22 while the sample chamber door 11 is closed. This exemplary prior art solution involves adding valves or other mechanisms to the sample chamber and the input and output gas ports. These valves or mechanisms are then operated or opened and closed manually in specific sequences prior to the sample chamber being opened and closed in order to create the bypass, purge and restore functions. Providing these functions manually requires additional time to open and close valves between samples, thereby reducing system throughput. In addition, requiring such a sequence of steps each time a sample is introduced increases system complexity, increases system and maintenance cost, and makes mistakes in operation more likely.

Accordingly, there is a continuing need for a way to introduce samples to a sample chamber including gas bypass, purge and restored flow in a laser ablation mass spectroscopy system automatically as the sample chamber is opened and closed to obviate the need for slow and error prone manual processes.

SUMMARY OF THE INVENTION

Aspects of this invention are improvements to sample chamber design for laser assisted spectroscopy (LAS). These aspects improve sample chamber design by automatically redirecting flow of fluids to permit the sample chamber to be opened and closed to introduce new samples without allowing room atmosphere to be passed from the sample chamber to the spectroscope. In addition to LAS, these sample chamber improvements could be advantageously applied to other instruments or devices that desire processing a sample in a gas flow while also desiring to open and close a sample chamber, including mass spectrometers and some optical spectrometers or spectrophotometers. These aspects include a sample chamber having a gas inlet, a gas outlet, a vent and a sample drawer having first, second and third positions. These aspects also include having an inlet valve connected to a gas inlet and operatively connected to a sample drawer so that: 1. when the sample drawer is set to the first or open position the inlet valve directs the gas flow from the gas inlet to the gas outlet thereby bypassing the sample chamber; 2. when the sample drawer is set to the second or partially open position the inlet valve directs the gas flow from the gas inlet to the partially open drawer thereby purging the sample chamber; and, 3. when the sample drawer is set to the third or closed position the inlet valve directs gas flow from said gas inlet to said sample chamber thereby restoring gas flow to the sample chamber. These aspects further include a sample chamber having an outlet valve connected to a gas outlet, a sample chamber and a vent, and operatively connected to a sample drawer so that: 1. when the sample drawer is set to a first or open position the outlet valve directs the gas flow from the inlet valve to the gas outlet thereby bypassing the sample chamber; 2. when the sample drawer is set a second or partially open position said outlet valve closes the gas outlet thereby purging the sample chamber; and, 3. when the sample drawer is set to a third or closed position the outlet valve directs the gas flow from the sample chamber to the gas outlet thereby restoring the flow of gas through the sample chamber. These aspects of the invention cooperate to automatically alter the flow of inert gas within the sample chamber as the sample door is opened and closed between bypass, a purge and a restored flow position in order to maintain the flow of inert gas to the mass spectrometer and prevent outside atmosphere from entering the sample chamber.

Aspects of this invention which accomplish bypass, purge and restored flow automatically as a sample chamber is opened and closed are illustrated in FIGS. 2*a*-*c*. In FIG. 2*a*, the sample drawer is fully opened, causing the sample chamber to bypass the inert gas around the sample drawer while preventing room atmosphere from entering the sample chamber. In FIG. 2*b*, the sample drawer is partially opened, allowing inert gas to pass from the gas inlet through the sample drawer to the room atmosphere while keeping the outlet port closed, thereby purging the sample chamber. In FIG. 2*c*, the drawer is closed, and both the inlet and outlet ports are opened, thereby restoring normal flow to the system. In this way, aspects of the current invention are able to automatically maintain a bypass flow of inert gas while the sample chamber is opened, purge the sample chamber as the sample drawer is closed and restore the flow of inert gas over a sample as the sample chamber is opened and closed, thereby allowing the sample chamber to be opened and closed while minimizing contamination from room atmosphere and without requiring any operation of additional valves or other equipment.

Accordingly, the invention is an improved method and apparatus for automatically re-directing the flow of a fluid through a sample chamber so that when the sample chamber is opened the flow of fluid is prevented from entering the chamber, when the chamber is partially opened the flow of fluid enters the chamber for purging and when the chamber is closed resumes fluid flow over the sample and on to an instrument.

DETAILED DESCRIPTION OF THE PREFERRED EMBODIMENTS

Figure 2A:
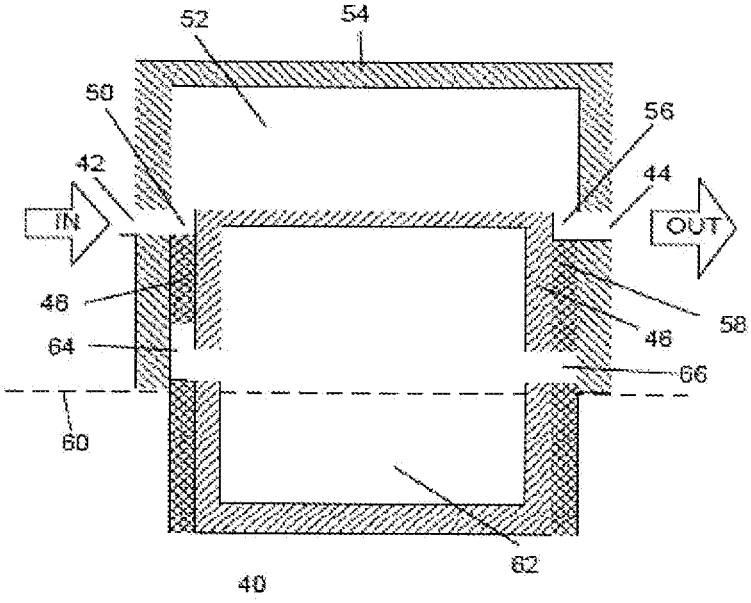
FIG. 2*a*. Sample chamber in bypass mode.

Referring to FIGS. 2*a*, *b* and *c*, an embodiment of this invention is an improved sample chamber 40 for laser processing a sample (not shown) in a fluid flow (shown by the arrows marked "IN" and "OUT", fluid flow is provided by a source not shown), the improved sample chamber 40 having a fluid inlet 42, a fluid outlet 44, and a sample drawer 46 (right-hand diagonal fill) having first (FIG. 2*a*), second (FIG. 2*b*) and third (FIG. 2*c*) positions. The improvements further comprise an inlet slide 48 communicating with the fluid inlet 42, a fluid outlet 44, and operatively connected to the sample drawer 46 so that when said sample drawer 46 is set to the first or open 62 position (FIG. 2*a*) the inlet slide 48 (cross hatch fill) directs said fluid flow from the fluid inlet. 42 to the fluid outlet 44. When the sample drawer 46 is set to the second or partially open position (FIG. 2*b*) the inlet slide 48 directs the fluid flow from the fluid inlet 42 to the sample drawer 46. When the sample drawer 46 is set to the third position (FIG. 2*c*) the inlet slide 48 directs the fluid flow from the fluid inlet 42 to the sample drawer 46.

The improvements further comprise an outlet slide 58 (cross hatch fill) communicating with a fluid outlet 44 and the inlet slide 48 and operatively connected to a sample drawer 46 so that when the sample drawer 46 is set to a first position (FIG. 2*a*) the outlet slide 58 directs the fluid flow from the bypass plenum 52 to the fluid outlet 44. When the sample drawer is 46 set to the second position (FIG. 2*b*) the outlet slide 58 closes the fluid outlet 44. When the sample drawer 46 is set to the third position (FIG. 2*c*) the outlet slide directs the fluid flow from the sample drawer 46 to the fluid outlet 44.

In more particular, an embodiment of this invention is an improved sample chamber 40 for laser processing a sample (not shown) in a fluid flow (shown by the arrows marked "IN" and "OUT), the improved sample chamber 40 having a fluid inlet 42, a fluid outlet 44, and a sample drawer 46 having first (FIG. 2*a*), second (FIG. 2*b*) and third (FIG. 2*c*) positions. The fluid flow, which may be an inert gas and which preferably may be one of helium or argon, enters the sample chamber 40 via the fluid inlet 42, which passes through the drawer enclosure 54 (left-hand diagonal fill), which supports and encloses the sample drawer 46 (right-hand diagonal fill). When the sample drawer is in the first or open 62 position (FIG. 2*a*) the bypass inlet opening 50 in the inlet slide 48 (cross-hatch fill) aligns with the fluid inlet 42 and the bypass plenum 52, permitting fluid to pass front the fluid inlet 42 to the bypass plenum 52. The dotted line 60 represents the bezel or front surface of the sample chamber 40; therefore when the sample drawer 46 extends beyond the front surface of the sample chamber 60 as in FIG. 2*a*, the interior of the sample drawer 46 will be open 62 and exposed to room atmosphere. With the sample drawer 46 in the first or open 62 position (FIG. 2*a*) the bypass outlet opening 56 in the outlet slide 58 (cross-hatch fill) aligns with the bypass plenum 52 and the fluid outlet 44 to permit fluid to pass from the bypass plenum 52 to the fluid outlet 44 while preventing room air from the open 62 sample drawer 46 from entering the fluid outlet 44. In this way the sample chamber can maintain a flow of fluid to the instrument (not shown) attached to the fluid outlet 44 while the sample drawer 46 is open 62 to room atmosphere without permitting contamination of the fluid flow.

When the sample drawer 46 is in the second or partially open 68 position (FIG. 2*b*) the purge/restore inlet opening 64 in the inlet slide 48 aligns with the fluid inlet 42 and the sample drawer 46 to permit fluid to flow from the fluid inlet 42 to the sample drawer 46. When the sample drawer 46 is in the partially open 68 position, the fluid entering the sample drawer via the purge/restore inlet opening 64 exits the sample drawer 46 through the opening 68 to the room atmosphere. With the sample drawer 46 in the partially open 68 position, the restore opening 66 in the outlet slide 58 is not aligned with the fluid outlet 44, thereby preventing any room atmosphere from entering the fluid outlet and contaminating the fluid flow to the instrument (not shown). Note that in this position, the sample drawer 46 is open 68 only a small amount with respect to the sample chamber front surface 60, restricting the flow of fluid, therefore fluid flow will not have to be increased to successfully purge all room atmosphere from the sample drawer 46, nor will flow have to be increased to prevent room atmosphere from reaching the instrument, since the fluid outlet 44 is closed by outlet slide 58.

Figure 1A:
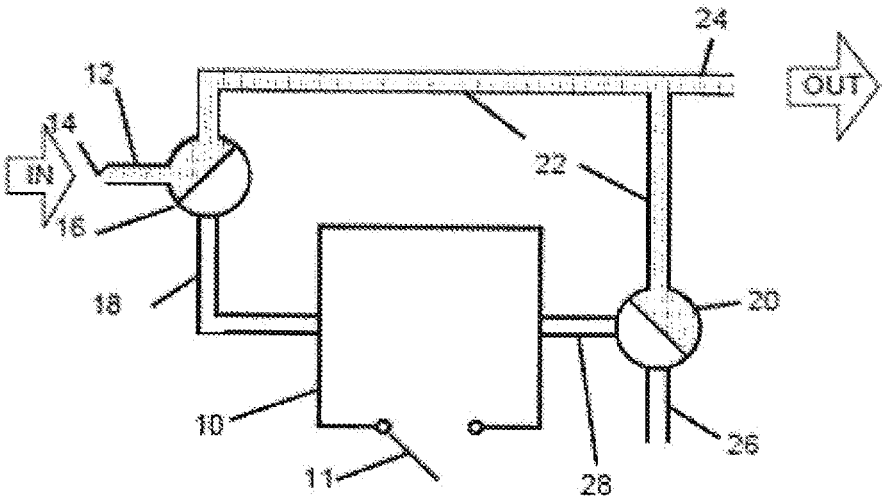
Fig 1a Prior Art
FIG. 1*a*. Prior art sample chamber in bypass mode.
Figure 1B:
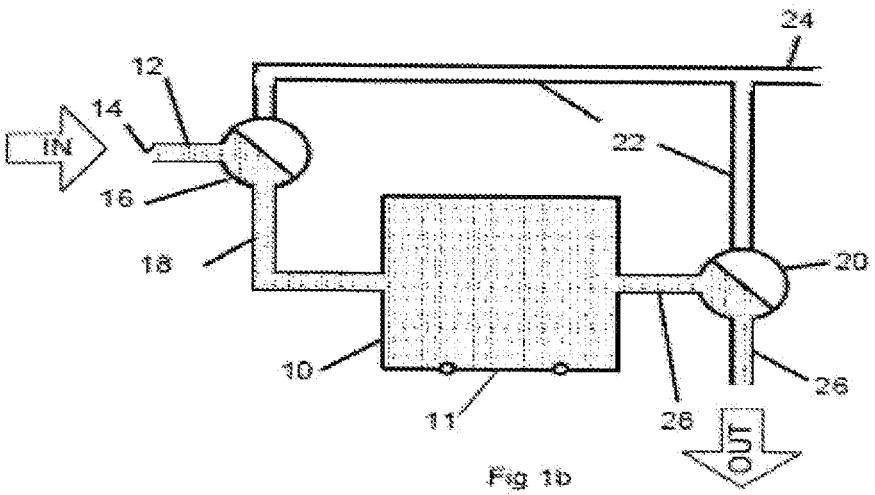
Fig 1b Prior Art
FIG. 1*b*. Prior art sample chamber in purge mode.
Figure 1C:
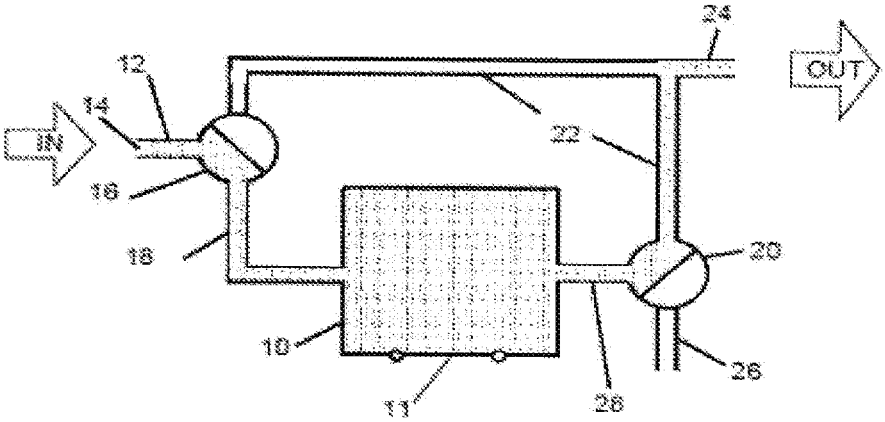
Fig 1c Prior Art
FIG. 1*c*. Prior art sample chamber in operating mode.
Figure 2C:
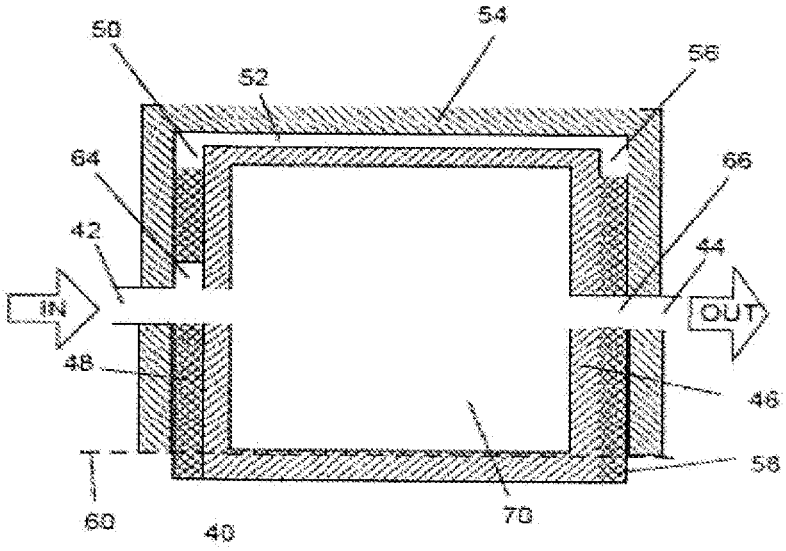
FIG. 2*c*. Sample chamber in operating mode.
Figure 3:
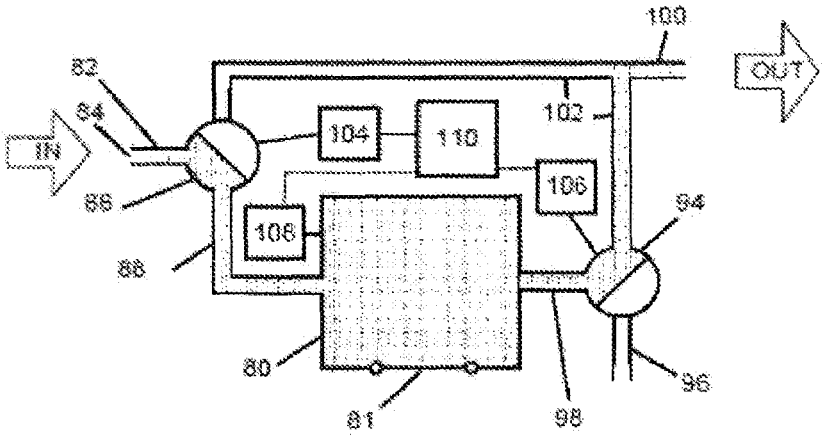
FIG. 3. Sample chamber with external controls.

When the sample drawer 46 is in the third or closed 70 position (FIG. 2*c*), the purge/restore inlet 64 in the inlet slide 48 aligns with the fluid inlet 42 allowing fluid entering the fluid inlet 42 to pass through to the sample drawer 46. With the sample drawer 46 closed 70, the fluid passes through the restore outlet 66 in the outlet slide 58 which is aligned with the fluid outlet 44 and permits fluid to pass through the sample drawer over the sample (not shown) and onto the instrument (not shown). Note that since the sample drawer 46 is closed 70 to room atmosphere (interior of sample drawer 46 is completely behind front surface of sample chamber 60), no contamination of fluid flow by room atmosphere is possible. With respect to room atmosphere contamination, it is worth noting that since these embodiments rely on fluid flow pressurized above normal room atmosphere pressure, application of seals to the mating surfaces of this invention is not critical. Any leakage that occurs will be leakage of pressurized fluid to the room atmosphere, therefore the application of seals to the mating surfaces of this invention will serve to prevent loss of possibly valuable fluids, not prevent contamination of the instrument. By constructing and using a sample chamber according to the disclosures herein, a sample chamber is created that will automatically provide bypass, purge and restored fluid flow to a sample chamber as the sample drawer is opened and closed without permitting contamination of the attached instrument or requiring additional steps to make the system ready for processing. It is also envisioned that embodiments of this invention may be constructed of fewer or more parts arranged in similar relationships without deviating from the spirit and intent of this invention. It is also envisioned that embodiments could use mechanical linkages or electrical sensor and actuators such as motors or solenoids to cause the opening and closing of valves to create bypass, purge and restored gas flow as the sample chamber door is opened and closed and thereby accomplish aspects of this invention. This is illustrated in FIG. 3, where the sample chamber 80 with access door 81 having a fluid inlet 82, a fluid outlet 100, fluid flow 84 from the fluid inlet 82 through the inlet valve 86, to the sample chamber 80 via the inlet channel 88 and thence to the fluid outlet 100 via the outlet channel 98, the outlet valve 94 and the bypass channel 102. This embodiment has in addition a controller 110 operatively connected to inlet actuator 104, outlet actuator 106, and sample chamber actuator 108 which are operatively attached to inlet valve 86, outlet valve 94 and sample chamber 80 respectively. In addition, the controller may have sensors (not shown) attached to the sample chamber 80, sample chamber door 81, inlet valve 86 and outlet valve 94 to detect the status of each. In this embodiment the controller 110 either detects the sample chamber door 81 opening or directs the sample chamber actuator 108 to open the sample chamber door 81, and then directs inlet actuator 104 and outlet actuator 106 to assume positions as shown in FIG. 1*a*, thereby creating a bypass condition, When the controller 110 subsequently either detects the sample door 81 closing or directs the sample chamber actuator 108 to close the sample chamber door 81, the controller 110 directs the inlet actuator 104 and outlet actuator 106 to set the inlet valve 86 and outlet valve 94 to the purge position as shown in FIG. 1*b*, thereby purging the sample chamber 80 via the outlet channel 98, the outlet valve 94 and the vent 96. When the controller 110 detects or predicts that the sample chamber 80 is fully purged, it directs inlet and outlet actuators 104, 106 to set the inlet valve 86 and outlet valve 94 to the restore flow position as illustrated in FIG. 1*e*. This embodiment could also operate by sensing the position of the sample door 81 without sample chamber actuator 104.

Figure 3A:
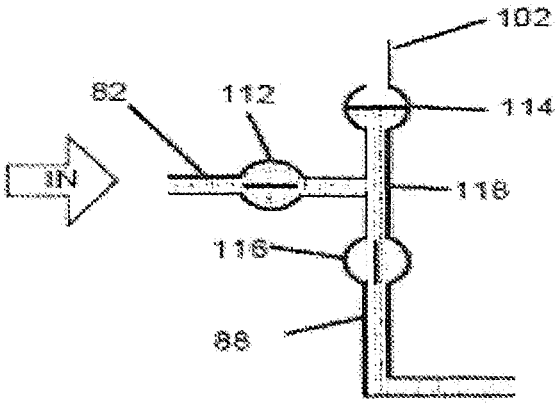
FIG. 3*a*. Alternate valve arrangement.

FIG. 3*a* shows another embodiment of this invention, wherein any one of the complex valve mechanisms, for example valves 86, 94 from FIG. 3, may be replaced by simple on/off valves 112, 114, 116, possibly connected by a connector "tee" 118. Replacing a single complex valve mechanism with one or more simple valves provides the same fluid directing function as employed by other embodiments of this invention. FIG. 3*a*, valves 112, 114 and 116, along with "tee" section 118, direct flow from fluid inlet 82 to either the inlet channel 88 or the bypass channel 102 or neither.

Figure 2B:
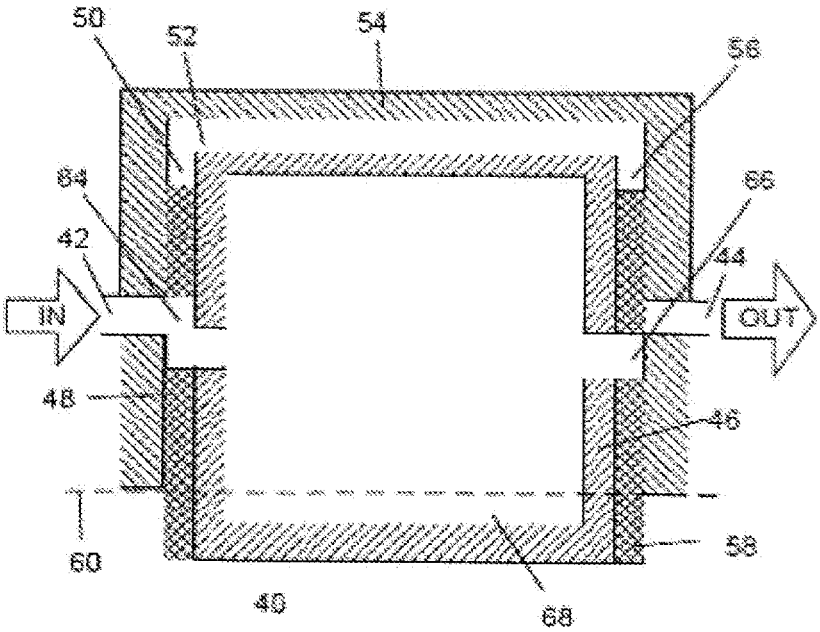
FIG. 2*b*. Sample chamber in purge mode.
Figure 4:
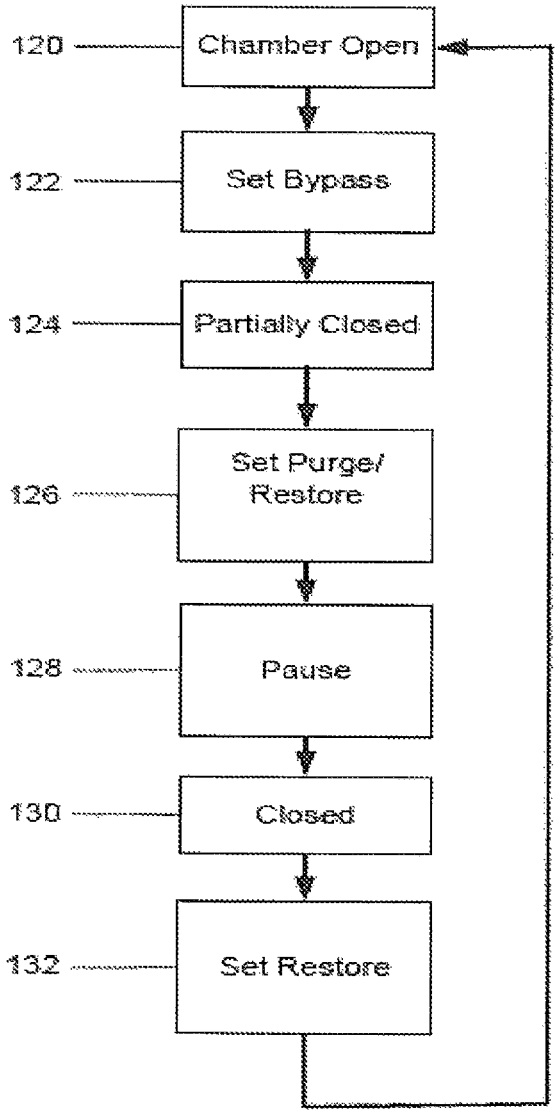
FIG. 4. Flowchart showing operation of sample chamber.
Figure 5:
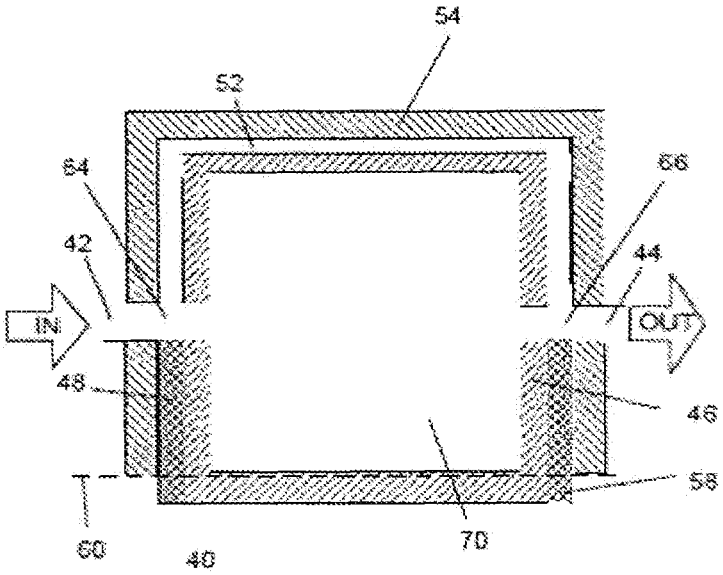
FIG. 5. Sample chamber with full time bypass.

FIG. 4 is a flow chart which illustrates the steps followed by embodiments of this invention as the sample chamber is opened to room atmosphere to insert samples and subsequently closed for processing. In step 120 the sample chamber is detected being opened or directed to open. Simultaneously or soon following, in step 122, the gas inlet and outlet are set to the bypass position (FIG. 2*a*). Subsequently, when the embodiment detects or directs the sample door in step 124 to either partially close or initially close, the inlet is set in step 126 to purge/restore while leaving the outlet valve in bypass position (FIG. 2*b*). Then a pause ensues in step 128 to permit the sample chamber to fully purge. This pause may be automatically controlled by the embodiment or left to the user to perform. In step 130 the door is closed and purging is complete. At this point, in step 132 the inlet and outlet are set to restore the flow to the chamber (FIGS. 2*c*, 3, 5). When the sample chamber is again opened, the flowchart returns to step 120.

In another embodiment of this invention, the gas bypass is arranged so that gas is always flowing around the sample chamber and opening and closing the sample drawer causes the gas to purge and restore flow as the drawer is opened sand partially closed, and then fully closed. This is illustrated in FIG. 5. FIG. 5 shows an embodiment of this invention that provides continuous bypass flow to the fluid outlet. This is accomplished by modifying the inlet and outlet slides 48 and 58 to permit flow through the bypass plenum 52 regardless of the position of the sample drawer 46. This embodiment results in a slightly simpler design but at the cost of requiring increased fluid flow.

Figure 6:
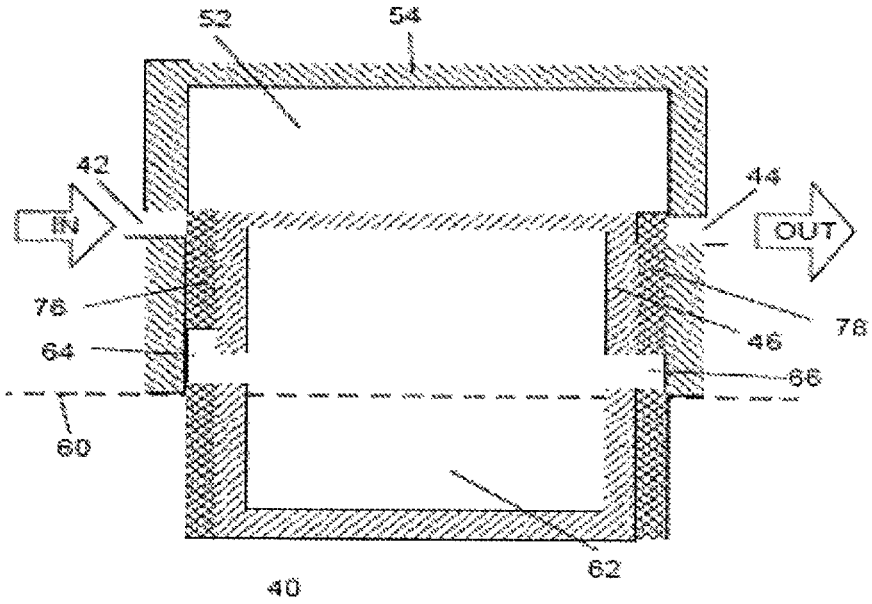
FIG. 6. Sample chamber without bypass.

Referring to FIG. 6, another embodiment of this invention adds additional input slides 76, 78 to block bypass fluid flow, thereby preventing fluid flow through the chamber except when the chamber is closed 70. This supports spectral analysis instruments that do not require bypass flow to remain in operation while the sample chamber is opened.

Figure 7:
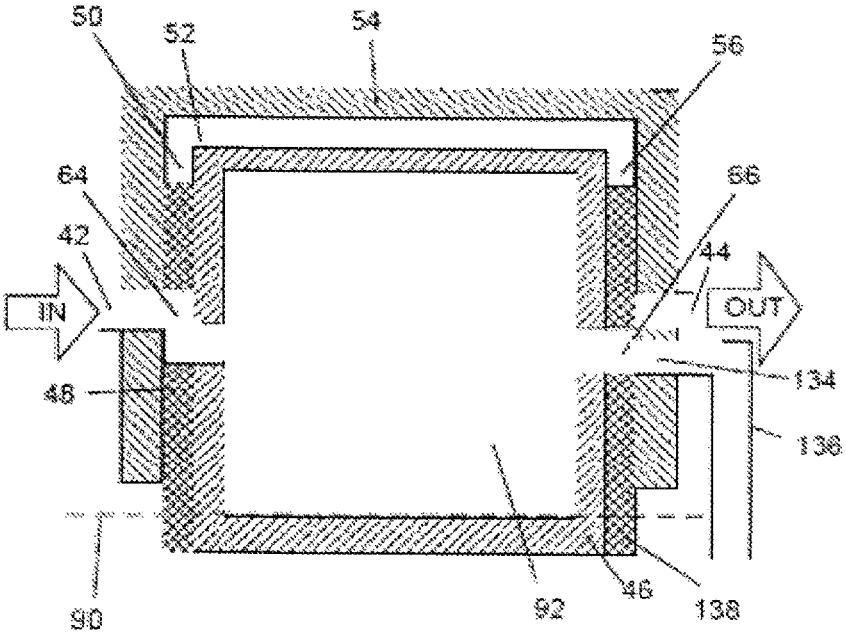
FIG. 7. Sample chamber with alternate purge.

In FIG. 7 an embodiment of this invention is constructed so that when the sample drawer 46 is in the purge position 92 the bezel 90 closes the drawer 46 from the room atmosphere. The modified outlet slide 138 has an additional opening, a purge outlet 134, which, when the sample drawer 46 is in the purge position 92, aligns with the restore outlet 66 and the outlet vent 136 to allow the sample chamber to purge room atmosphere prior to restoring flow with the sample chamber closed completely.

Having hereby disclosed the subject matter of the present invention, it should be obvious that many modifications, substitutions, and variations of the present invention are possible in view of the teachings. It is therefore understood that the invention may be practiced other than as specifically described, and should be limited in its breadth and scope only by the Claims:

We claim:

1. A sample chamber system including a sample chamber having an access opening adapted to have an open position to allow insertion of a sample into said sample chamber and to have a closed position in which said sample chamber is closed in a sealing manner, said system comprising:

a first valve being configured to switch between open and closed states in direct dependence on change in position of the access opening such that said first valve is in the open state and a volume of said sample chamber is in gas flow communication with a source of a carrier gas when (1) the access opening is in transition between the closed position and the open position to cause outflow from the volume through the access opening, when (2) the access opening is in transition between the open position and the closed position to cause outflow from the volume through the access opening, and when (3) the access opening is in the closed position to provide the carrier gas over a sample in the sample chamber, and said first valve is in the closed state and the volume of the sample chamber is not in gas flow-communication with said source of a carrier gas when (1) the access opening is in the open position to permit placement of a sample in the sample chamber; and a second valve being configured to switch between open and closed states in direct dependence on change in position of the access opening, such that said second valve is in the open state and said volume of said sample chamber is in gas flow communication with a spectral analysis location when (1) the access opening is in the closed position to provide gas flow from the sample chamber to the spectral analysis location, and said second valve is in the closed state and said volume is not in gas flow-communication with said spectral analysis location when (1) the access opening is in the open position, (2) the access opening is in transition between the closed position and the open position to prevent contamination of the spectral analysis location, and (3) the access opening is in transition between the open position and the closed position to prevent contamination of the spectral analysis location.

2. The system of claim 1 wherein said access opening is a door and corresponding doorway.

3. The system of claim 1 wherein said position dependence being a result of a mechanical relationship between said access opening and said first valve and said second valve.

4. The system of claim 3, said mechanical relationship being a result of a mechanical actuator in mechanical communication between said access opening and said first valve and said second valve.

5. The system of claim 1 said position dependence being a result of an electrical actuator in mechanical communication with said first valve and said second valve, said electrical actuator providing a positional force based upon a position input signal, said signal being based upon said access opening position.

6. A sample chamber for holding a sample in a gas flow separate from room atmosphere having a gas inlet port, and a gas outlet port comprising;

an access port operative to permit access to said sample chamber and having first, second and third positions so that;

when said access port is in said first position, said access port is operative to direct said gas flow from said inlet port to said outlet port while preventing said room atmosphere from entering said outlet port thereby providing bypass flow;

when said access port is in said second position, said access port is operative to direct gas flow from said inlet port to said sample chamber and out through the access port while preventing said room atmosphere from entering said outlet port thereby providing purge flow; and when said access port is in said third position, said access port is operative to direct said gas flow from said inlet port to said sample chamber and then to said outlet port thereby providing restored flow.

7. The sample chamber of claim 6 wherein the processing system is one of a laser ablation inductively coupled plasma mass spectroscope, a laser ablation inductively coupled plasma emission spectroscope or a matrix assisted laser desorption ionization time of flight spectroscope.

8. The sample chamber of claim 6 wherein said first position is open to allow placement of a sample in the sample chamber through the access port, said second position is partially open and said third position is closed to isolate the sample chamber from exposure to a room atmosphere.

9. The sample chamber of claim 6 wherein said gas flow is an inert gas.

10. The sample processing system of claim 9 wherein said inert gas is one of helium or argon.

11. The sample processing system of claim 6 wherein said gas flow is between 0.05 L/min and 1.0 L/min.

* * * * *